United States Patent [19]

Gaertner

[11] 4,141,198

[45] Feb. 27, 1979

[54] REVERSIBLE STIRRUP LEATHER BUCKLE

[75] Inventor: Rudolph F. Gaertner, Yoakum, Tex.

[73] Assignee: Tandy Brands, Inc., Fort Worth, Tex.

[21] Appl. No.: 820,152

[22] Filed: Jul. 29, 1977

[51] Int. Cl.[2] ..... B68C 1/16; A44B 11/20

[52] U.S. Cl. ..... 54/46; 24/164; 24/177

[58] Field of Search ..... 54/45, 46, 47, 48, 49, 54/49.5; 24/163, 164, 166, 174, 177, 181, 190; 2/322

[56] References Cited

U.S. PATENT DOCUMENTS

| | | | |
|---|---|---|---|
| 1,792,158 | 2/1931 | Gleckner | 2/322 X |
| 2,718,682 | 9/1955 | Nichols | 54/47 X |
| 2,730,853 | 1/1956 | Manning | 54/46 |
| 3,096,552 | 7/1963 | Kreger, Jr. | 24/177 X |
| 3,209,423 | 10/1965 | Cattin | 24/181 |
| 3,314,121 | 4/1967 | Blevins et al. | 24/181 |

*Primary Examiner*—Russell R. Kinsey
*Assistant Examiner*—Robert P. Swiatek
*Attorney, Agent, or Firm*—Diller, Ramik & Wight

[57] ABSTRACT

This relates to an adjustable stirrup leather which has a buckle construction of a nature wherein the billet end of the leather may be selectively placed in front of the buckle or rearwardly of the buckle depending upon the adjusted length of the stirrup leather so as always to be in an out-of-the-way position. This is accomplished by means of a buckle which may be selectively set to receive the billet leather on either side or face thereof, and there is associated with the billet leather and buckle a reversible slide for retaining the buckle interlocked with the billet leather.

8 Claims, 5 Drawing Figures

FIG.1
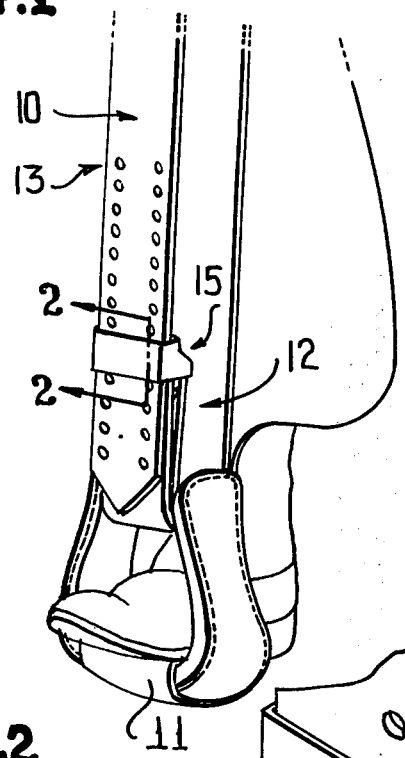
FIG.4
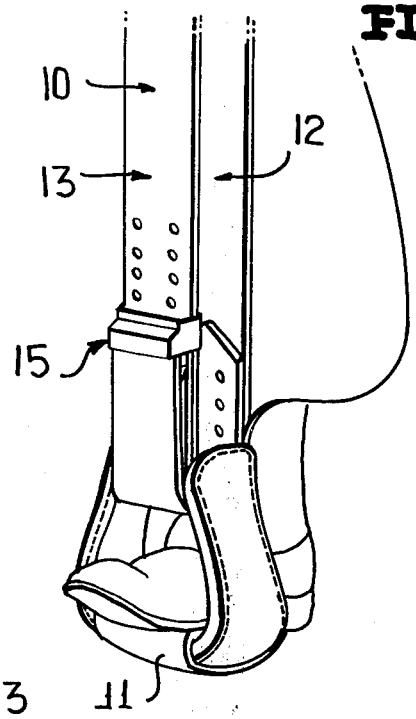
FIG.2
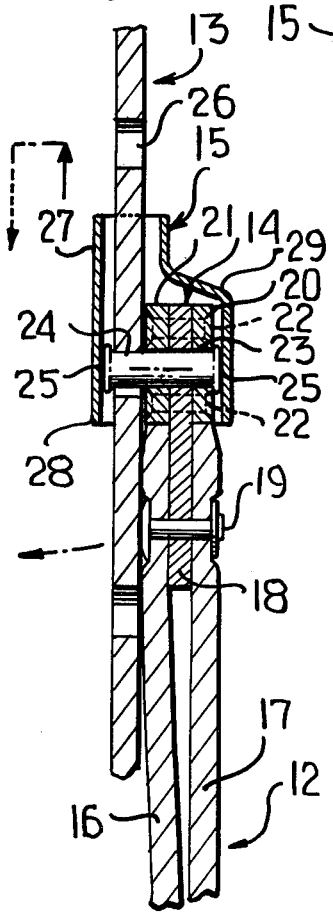
FIG.3
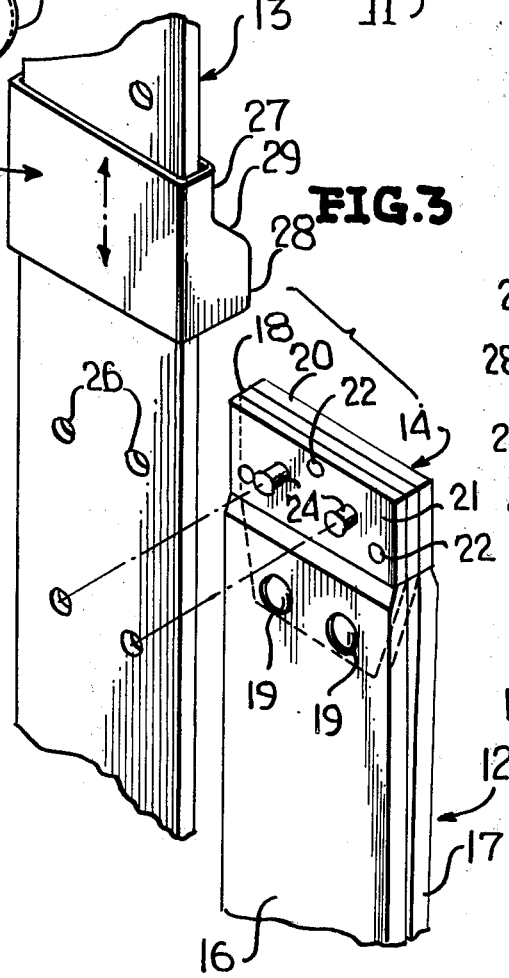
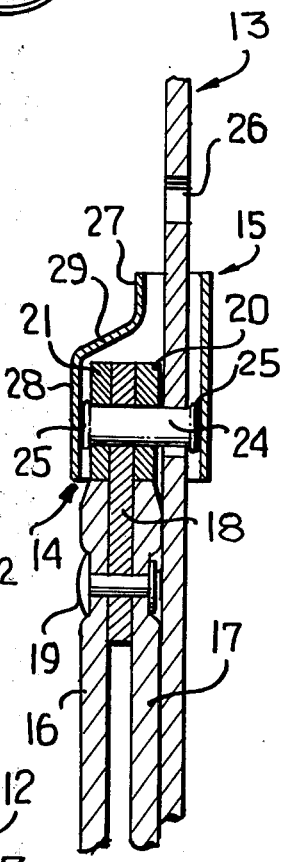
FIG.5

REVERSIBLE STIRRUP LEATHER BUCKLE

This invention relates to an adjustable stirrup leather which may be reversed, as the rider chooses, to place the leather either in front of or behind the buckle when it is locked into place. The adjustible stirrup leather provides for a rapid method of changing the length of the stirrup leather to accommodate riders of different inseam length without the excess billet leather being in the way of the rider's foot projecting through the associated stirrup.

The majority of existing types of stirrup leather buckles are designed to be permanently attached to the lower portion of the fender. When the buckle is locked into position, the billet end of the leather goes over the top of the tree bar and down on the outside of the bottom of the fender where it is buckled into place. The stirrup is threaded into this continuous loop formed by the stirrup leather. With the tip of the billet leather in front of the buckle, a shield is formed to prevent brush or weeds from hanging in the leather and irritating the horse. However, when the stirrup leather is adjusted to one of its shorter lengths, the billet end hangs down in front of the stirrup. This creates a safety hazard due to the possibility of the rider's foot binding in the stirrup between the billet leather and the side of the stirrup. Since in many cases the short legged rider is a child or an inexperienced rider, the hazard is compounded.

The risk of the excess billet leather binding the rider's foot in the stirrup may be eliminated in two ways. First, the end of the billet leather may be trimmed off so that it no longer extends in front of the stirrup. This is done after the leathers have been adjusted to the desired length to fit a short legged individual. By doing this, however, the billet leather can no longer be extended to its full length and thus this restricts the full use of the saddle. Second, the buckle can be removed from the end of the stirrup leather, reversed, and then re-riveted. When the buckle is fastened in its new position, the billet end of the leather is on the underside of the buckle and does not extend in front of the stirrup. This does not allow full adjustment of the stirrup leather without the hazard of excess leather causing the foot to bind in the stirrup. However, when the stirrup leather is adjusted to fit a longer legged individual, the buckle assembly is lower, closer to the ground, and there is always the possibility of brush catching in the stirrup leather and rubbing the horse.

In accordance with this invention, there is provided a permanently mounted stirrup leather buckle with which one can utilize the full adjustment potential without the foregoing deficiencies. When the saddle is used by a longer legged individual, the billet end of the stirrup leather in accordance with this invention is in the normal position, in front of the bottom portion. When the stirrup leather is shortened to accommodate a smaller rider, a metal slide on the billet leather holding the billet leather onto pins in the buckle is reversed, and the pins in the buckle are positioned through to protrude in the opposite direction. Thus, when the buckle is locked in place, the billet end is on the underside of the leather and does not extend down in front of the stirrup. The buckle remains in absolutely the same relationship to the ground and is high enough to eliminate the opportunity for brush or weeds to hang in it.

The stirrup leather arrangement of this invention makes it possible for instant "on the spot" adjustments to the stirrup leather, positioning the billet leather on either the inside or the outside of the unit as the rider prefers. No sacrifice of safety, comfort, or adjustability is necessary. For all practical purposes, the adjustable stirrup leather makes it possible for any number of individuals easily to use the same saddle.

The present invention will now be described in relation to the accompanying drawing which illustrates a preferred embodiment, it being understood that this illustration is given by way of non-limiting example only.

IN THE DRAWINGS:

FIG. 1 is a perspective view showing the stirrup leather of this invention adjusted to support a stirrup for use by a long legged rider;

FIG. 2 is an enlarged fragmentary vertical sectional view taken generally along the line 2—2 of FIG. 1, and shows specifically the construction of the stirrup leather including the buckle components thereof;

FIG. 3 is a fragmentary exploded view of the stirrup leather with the billet leather being separated from the buckle;

FIG. 4 is a perspective view similar to FIG. 1 showing the stirrup leather adjusted for a short legged rider; and FIG. 5 is a vertical sectional view similar to FIG. 2, showing the relationship of the billet leather and the buckle in the adjusted position of FIG. 4.

Referring now to the drawings in detail, it will be seen that there is illustrated in FIG. 1 an adjustable stirrup leather formed in accordance with this invention and generally identified by the numeral 10. The stirrup leather 10 suspends a conventional stirrup 11 from a saddle in a conventional manner, the saddle being omitted.

Basically, the stirrup leather is in the form of an adjustable continuous loop receiving the upper part of the stirrup 11. For descriptive purposes, although the stirrup leather 10 may be formed of a single length of leather, the stirrup leather includes a buckle leather 12 and a billet leather 13. The buckle leather 12 carries a buckle 14, which is adjustably associated with the billet leather 13. In order to retain the billet leather in an adjusted, coupled position with respect to the buckle 14, there is carried by the billet leather a slide generally identified by the numeral 15.

In the preferred embodiment of the invention, the buckle leather 12 includes two strap portions 16, 17 to which the buckle 14 is secured. The buckle 14 includes a buckle plate 18 which has a portion thereof telescoped between the free ends of the straps 16, 17 and fixedly secured thereto by means of a pair of rivets 19.

The buckle 14 also includes a pair of filler plates 20, 21 disposed on opposite sides of the buckle plate 18 and fixedly secured thereto by means of rivets 22. The filler plates 20, 21 and the buckle plate 18 have aligned openings 23 therethrough, and extending through each set of openings 23 is a pin 24. Each pin 24 is provided at the opposite ends thereof with an enlarged head 25. The fit of the pins 24 in the filler plates 20, 21 and the buckle plate 18 is one wherein the pin is frictionally held in place but wherein the pin may be slid therethrough. It is to be noted that each pin 24 is of a length to project to one side of the buckle for engagement with the billet leather 13. The pins 24 are retained within the buckle plate 18 and the filler plates 20, 21 by the head 25.

In the normal position of the stirrup leather 10, the pins 24 project outwardly from the filler plate 21, as is shown in FIG. 2. The protruding portions of the pins 24 are selectively received in apertures 26 formed in the billet leather 13, the apertures 26 being arranged in pairs which are spaced apart in accordance with the spacing of the pins 24.

As will be apparent from FIG. 2, the slide 15 is of a tubular construction and includes an upper portion 27 which is of a size free to slide over the billet leather 13. The slide 15 also includes an integral lower portion 28 which is of a larger depth than the upper portion 27 and is of a size to have received therein both the billet leather 13 and the buckle 14. Between the portions 27 and 28, the slide includes a shoulder 29 which limits the downward movement thereof over the buckle 14.

In the normal position of the slide 15, the enlarged lower portion 28 projects rearwardly and is telescoped over the buckle 14 which is also disposed to the rear of the billet end of the leather as is shown in FIG. 1. When the leather 10 is arranged in the manner illustrated in FIG. 1, the height of the stirrup 11 may be readily adjusted by moving the slide 15 upwardly on the billet leather, disengaging the billet leather 13 from the pins 24 to the position shown in FIG. 3, and then reinserting the pins 24 into another set of the apertures 26. When the stirrup leather 10 has been so adjusted, the slide 15 is once again moved downwardly on the billet leather and is telescoped over the buckle 14 in the manner shown in FIG. 2 to retain the interlock between the pins and the billet leather.

It will be readily apparent from FIG. 1 that if the stirrup leather 10 is so adjusted wherein a long portion of the billet leather extends down below the slide 15, it will be in the way of the rider's foot positioned within the stirrup 11. Thus, when it is necessary to adjust the stirrup leather 10 to position the stirrup 11 to accommodate a short legged rider, there will be excess billet leather 13 extending down in front of the stirrup. In order to avoid this, the slide 15 is elevated to release the buckle 14 and the buckle 14 is disconnected from the billet leather 13 in the normal manner of adjustment. The slide 15 is then removed from the billet leather, rotated 180° and repositioned on the billet leather with the enlarged portion 28 now facing forwardly, as shown in FIGS. 4 and 5. The pins 24 are pushed through the buckle plate 18 and the filler plates 20, 21 so as to protrude beyond the filler plate 20, as shown in FIG. 5.

The billet leather 13 is now positioned to the rear of the buckle leather 12 and is adjusted with respect to the buckle 14. The billet leather is then engaged over the pins 24 in the usual manner and the slide 15 moved downwardly into telescoped relation with respect to the buckle to hold the pins 24 interlocked with the billet leather as shown in FIG. 5.

Referring once again to FIG. 4, it will be seen that when the stirrup leather is properly adjusted to accommodate a short legged rider, the billet leather end is reversely turned within the lower portion of the buckle leather and is confined entirely within the stirrup leather and is disposed out of the way of the stirrup and the rider's foot. At the same time, the stirrup leather makes the same frontal presentation and is no more apt to be engaged with brush.

It will be readily apparent from the foregoing and the illustrations of the drawing that the stirrup leather may be readily adjusted in either of two positions of the buckle and that the stirrup leather may be returned to its original condition from its adjusted condition of FIG. 4 with a minimum of effort.

Although only a preferred embodiment of the invention has been specifically illustrated and defined herein, various modifications may be made in the stirrup leather without departing from the spirit and scope of the invention as defined by the appended claims.

I claim:

1. An adjustable stirrup leather comprising a buckle leather and a billet leather, said buckle leather having a buckle end including a projecting buckle plate having at least one pin extending transversely therethrough and projecting at one side of said buckle plate, the fit of said pin in said buckle plate being one wherein said pin may be shifted through said buckle plate for selecting that side of said buckle plate from which said pin extends, said billet leather including an end portion having a plurality of spaced apertures therein for selectively receiving said pin and thereby determining the effective length of said stirrup leather, and a slide telescopically carried by said billet leather and slideable over said buckle plate to retain said billet leather engaged on said pin, said slide being removably carried by said billet leather and rotationally positionable thereon wherein said billet leather may be selectively positioned in front of and to the rear of said buckle leather in accordance with the adjusted length of said stirrup leather and the amount of the excess billet leather in adjusted position of said stirrup leather.

2. The adjustable stirrup leather of claim 1 wherein there are at least two of said pins disposed in side-by-side relation and said billet leather has two rows of said apertures.

3. The adjustable stirrup leather of claim 1 wherein said slide is a tubular configuration and includes an upper end portion for receiving only said billet leather and a lower end portion for receiving both said billet leather and said buckle.

4. The adjustable stirrup leather of claim 1 wherein said buckle leather has two layers at said buckle plate with said buckle plate having a portion sandwiched between said two layers and secured thereto.

5. The adjustable stirrup leather of claim 4 wherein said buckle plate has secured to opposite sides thereof filler plates wherein that portion of said buckle extending beyond said buckle leather has a total thickness approximating the total thickness of said buckle leather two layers and said buckle plate.

6. The adjustable stirrup leather of claim 5 wherein said slide is a tubular configuration and includes an upper end portion for receiving only said billet leather and a lower end portion for receiving both said billet leather and said buckle.

7. The adjustable stirrup leather of claim 4 wherein said buckle plate has at each of opposite sides thereof an enlargement wherein that portion of the buckle having said enlargements extending beyond said buckle leather has a total thickness approximating the total thickness of said buckle leather two layers and said buckle plate.

8. The adjustable stirrup leather of claim 7 wherein said slide is a tubular configuration and includes an upper end portion for receiving only said billet leather and a lower end portion for receiving both said billet leather and said buckle.

* * * * *